US007005046B2

(12) United States Patent
Stevens et al.

(10) Patent No.: US 7,005,046 B2
(45) Date of Patent: Feb. 28, 2006

(54) APPARATUS FOR ELECTRO CHEMICAL DEPOSITION

(75) Inventors: Joseph J. Stevens, San Jose, CA (US); Yevgeniy Rabinovich, Fremont, CA (US); Sandy S. Chao, San Jose, CA (US); Mark R. Denome, San Jose, CA (US); Allen L. D'Ambra, Millbrae, CA (US); Donald J. Olgado, Palo Alto, CA (US)

(73) Assignee: Applied Materials Inc., Santa Clara, CA (US)

( * ) Notice: Subject to any disclaimer, the term of this patent is extended or adjusted under 35 U.S.C. 154(b) by 498 days.

(21) Appl. No.: 10/217,872

(22) Filed: Aug. 13, 2002

(65) Prior Publication Data

US 2003/0000841 A1 Jan. 2, 2003

Related U.S. Application Data

(63) Continuation of application No. 09/603,791, filed on Jun. 26, 2000, now Pat. No. 6,454,927.

(51) Int. Cl.
*C25D 17/00* (2006.01)

(52) U.S. Cl. ..... 204/275.1; 204/267

(58) Field of Classification Search ..... 205/101, 205/123; 204/274, 275.1, 267
See application file for complete search history.

(56) References Cited

U.S. PATENT DOCUMENTS

| | | | | |
|---|---|---|---|---|
| 5,368,715 | A | 11/1994 | Hurley et al. | |
| 5,858,196 | A | 1/1999 | Ikenaga | |
| 6,024,856 | A * | 2/2000 | Haydu et al. | 205/84 |
| 6,113,769 | A | 9/2000 | Uzoh et al. | |
| 6,551,479 | B1 * | 4/2003 | Graham et al. | 204/434 |

FOREIGN PATENT DOCUMENTS

| | | |
|---|---|---|
| EP | 0952242 | 10/1999 |
| WO | 9954527 | 10/1999 |
| WO | 9954920 | 10/1999 |

OTHER PUBLICATIONS

U.S. Appl. No. 09/082,521, filed Apr. 21, 1998.
U.S. Appl. No. 09/114,865, filed Jul. 13, 1998.
U.S. Appl. No. 09/263,126, filed Mar. 5, 1999.

* cited by examiner

*Primary Examiner*—Arun S. Phasge
(74) *Attorney, Agent, or Firm*—Konrad Raynes Victor & Mann

(57) ABSTRACT

A system is provided in which a smaller flow of deposition solution is diverted from a larger flow of deposition solution flowing on an electrochemical deposition tool platform. The smaller flow is diverted to a dosing unit which may be on a separate platform. The dosing unit in one embodiment comprises a pressurized flow line.

12 Claims, 6 Drawing Sheets

APPARATUS FOR ELECTRO CHEMICAL DEPOSITION

This application is a continuation of U.S. patent application Ser. No. 09/603,791 filed Jun. 26, 2000 now U.S. Pat. No. 6,454,927, which is incorporated herein by reference in its entirety.

BACKGROUND OF THE INVENTION

1. Field of the Invention

The present invention generally relates to deposition of a metal layer onto a wafer or other substrate. More particularly, the present invention relates to an electrochemical deposition system for forming a metal layer on a substrate.

2. Background of the Related Art

Sub-quarter micron, multi-level metallization is one of the key technologies for the next generation of ultra large scale integration (ULSI). The multilevel interconnects that lie at the heart of this technology require planarization of interconnect features formed in high aspect ratio apertures, including contacts, vias, lines and other features. Reliable formation of these interconnect features is very important to the success of ULSI and to the continued effort to increase circuit density and quality on individual substrates and die.

As circuit densities increase, the widths of vias, contacts and other features, as well as the dielectric materials between them, decrease to less than 250 nanometers, whereas the thickness of the dielectric layers remains substantially constant, with the result that the aspect ratios for the features, i.e., their height divided by width, increases. Many traditional deposition processes, such as physical vapor deposition (PVD) and chemical vapor deposition (CVD), have difficulty filling structures where the aspect ratio exceeds 4:1, and particularly where it exceeds 10:1. Therefore, there is a great amount of ongoing effort being directed at the formation of void-free, nanometer-sized features having high aspect ratios wherein the ratio of feature height to feature width can be 4:1 or higher. Additionally, as the feature widths decrease, the device current remains constant or increases, which results in an increased current density in the feature.

Elemental aluminum (Al) and its alloys have been the traditional metals used to form lines and plugs in semiconductor processing because of aluminum's perceived low electrical resistivity, its superior adhesion to silicon dioxide ($SiO_2$), its ease of patterning, and the ability to obtain it in a highly pure form. However, aluminum has a higher electrical resistivity than other more conductive metals such as copper, and aluminum also can suffer from electromigration leading to the formation of voids in the conductor.

Copper and its alloys have lower resistivities than aluminum and significantly higher electromigration resistance as compared to aluminum. These characteristics are important for supporting the higher current densities experienced at high levels of integration and increase device speed. Copper also has good thermal conductivity and is available in a highly pure state. Therefore, copper is becoming a choice metal for filling sub-quarter micron, high aspect ratio interconnect features on semiconductor substrates.

Despite the desirability of using copper for semiconductor device fabrication, choices of fabrication methods for depositing copper into very high aspect ratio features, such as a 4:1, having 0.35 micron (or less) wide vias are limited. As a result of these process limitations, plating, which had previously been limited to the fabrication of lines on circuit boards, is now being used to fill vias and contacts on semiconductor devices.

Metal electroplating is generally known and can be achieved by a variety of techniques. A typical method generally comprises physical vapor depositing a barrier layer over the feature surfaces, physical vapor depositing a conductive metal seed layer, preferably copper, over the barrier layer, and then electroplating a conductive metal over the seed layer to fill the structure/feature. Finally, the deposited layers and the dielectric layers are planarized, such as by chemical mechanical polishing (CMP), to define a conductive interconnect feature.

FIG. 1 is a flow circuit schematic diagram of a prior art electrochemical plating system 100 for depositing copper or other metals on a wafer or other substrate. The plating system 100 includes an electroplating tool platform 102 which has one or more electroplating cells 104 in which an electrolyte containing the material to be deposited, is circulated through each cell, to deposit the deposition material onto a wafer disposed within the cell 104. The deposition material is added to the electrolyte typically in the form of a chemical composition such as, for example, copper sulfate. The process of adding the deposition chemical to the electrolyte is often referred to as "dosing" and is usually performed by an electrolyte replenishment platform such as that indicated at 106.

The electrolyte replenishment platform 106, also often referred to as a "chemical cabinet," typically includes a large tank 108 in which the deposition chemical is mixed with the electrolyte. An analyzer 110 analyzes the chemical composition of the electrolyte and indicates whether additional deposition chemical or other chemicals should be added to the electrolyte in the tank 108 to maintain a desired composition of the electrolyte.

The electrolyte replenishment platform 106 typically includes a pump 112 to pump the electrolyte from the main tank 108 though a supply line 114 to the electroplating tool platform 102. To provide a sufficient flow of electrolyte to the cells 104 of the electroplating tool platform 102, the supply line 124 is often relatively large. For example, to provide a flow of 30 gallons per minute from the electrolyte replenishment platform 106 to the electroplating tool platform 102, the supply line 124 often has an inner diameter of 1 inch (25 mm) in many systems. Moreover, to save valuable clean room space adjacent to the electroplating tool platform 102, the electrolyte replenishment platform 106 is often located a relatively large distance from the platform 102, including being located on another floor of the factory. Hence, many systems have a second, booster pump 116 positioned on the electroplating tool platform 102 to provide sufficient head pressure to the plating cells 104.

Prior to admitting the electrolyte into the cells 104, many electroplating tool platforms have one or more filters 118 positioned upstream of the inlets to the cells 104, to filter the electrolyte from the electrolyte replenishment platform 106. Positioned downstream of the cells 104, the electroplating tool platform often has one or more intermediate holding tanks 120 to collect the flow of electrolyte from the cells 104. The electrolyte is then pumped by yet another pump 122, via a return line 124, back to the main tank 108 of the electrolyte replenishment platform 106 for analyzing and dosing if needed. Another filter or set of filters 126 is often provided on the electrolyte replenishment platform 106 to filter the electrolyte before it is admitted to the main tank 108 of the electrolyte replenishment platform 106.

To maintain the quality of the deposition onto the substrate in the cells, it is often desirable to closely control the temperature of the electrolyte to facilitate the desired chemical reaction in the electrolytic cells 104. In many systems such as that shown in FIG. 1, the main holding tank 108 of the electrolyte replenishment platform 106 typically has a chiller unit installed in the tank 108 to cool the electrolyte to the desired temperature prior to recirculating the electrolyte back into the cells 104.

The intermediate holding tanks 120 and the main holding tank 108 also usually have various sensors to monitor the electrolyte levels in the tanks. To avoid a potential overflow of hazardous electrolyte from the tanks, the flow rates by the various pumps 112, 116 and 122 are controlled to lower an excessive level of electrolyte in one tank and pump the excess to the other tank.

SUMMARY OF THE ILLUSTRATED EMBODIMENTS

In one illustrated embodiment of the present inventions, a method and apparatus for electroplating semiconductor substrates is provided which comprises recirculating electrolyte between an electrolyte reservoir and at least one electrolytic plating cell through a reservoir-cell fluid recirculation circuit disposed in an electroplating tool platform; and recirculating electrolyte between the reservoir and a dosing unit through a reservoir-dosing unit fluid recirculation circuit which couples a dosing system platform to the electroplating tool platform. The electrolyte is dosed in the dosing system platform with additives using the dosing unit.

As explained in greater detail below, in one embodiment, the majority of the electrochemical deposition solution, which in this embodiment is an electrolyte, recirculates locally in the electroplating tool platform. A relatively small flow of electrolyte may be diverted to the dosing system platform to be analyzed and dosed as needed. In addition, dosing may be achieved in a pressurized flow line rather than in an unpressurized reservoir or holding tank. As a consequence of these and other features discussed below, the complexity of the overall system can be substantially reduced and the reliability increased.

It should be understood that the preceding is merely a brief summary of one embodiment of the present inventions and that numerous changes to the disclosed embodiments can be made in accordance with the disclosure herein without departing from the spirit or scope of the inventions. The preceding summary, therefore, is not meant to limit the scope of the inventions. Rather, the scope of the inventions is to be determined only by the appended claims and their equivalents.

DETAILED DESCRIPTION OF THE DRAWINGS

Figure 2:
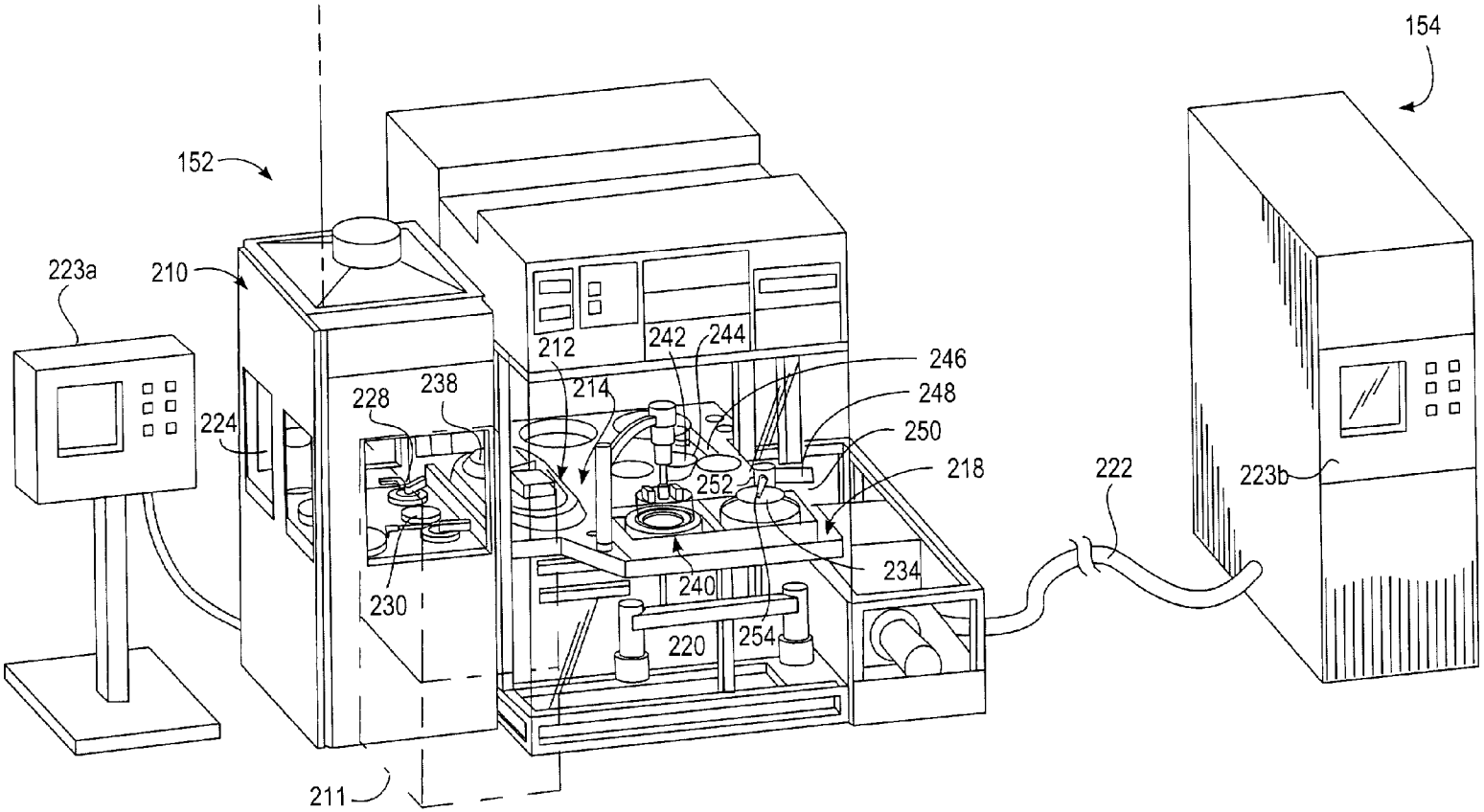
FIG. 2 is a perspective view of an electroplating system in accordance with one embodiment of the inventions.
Figure 3:
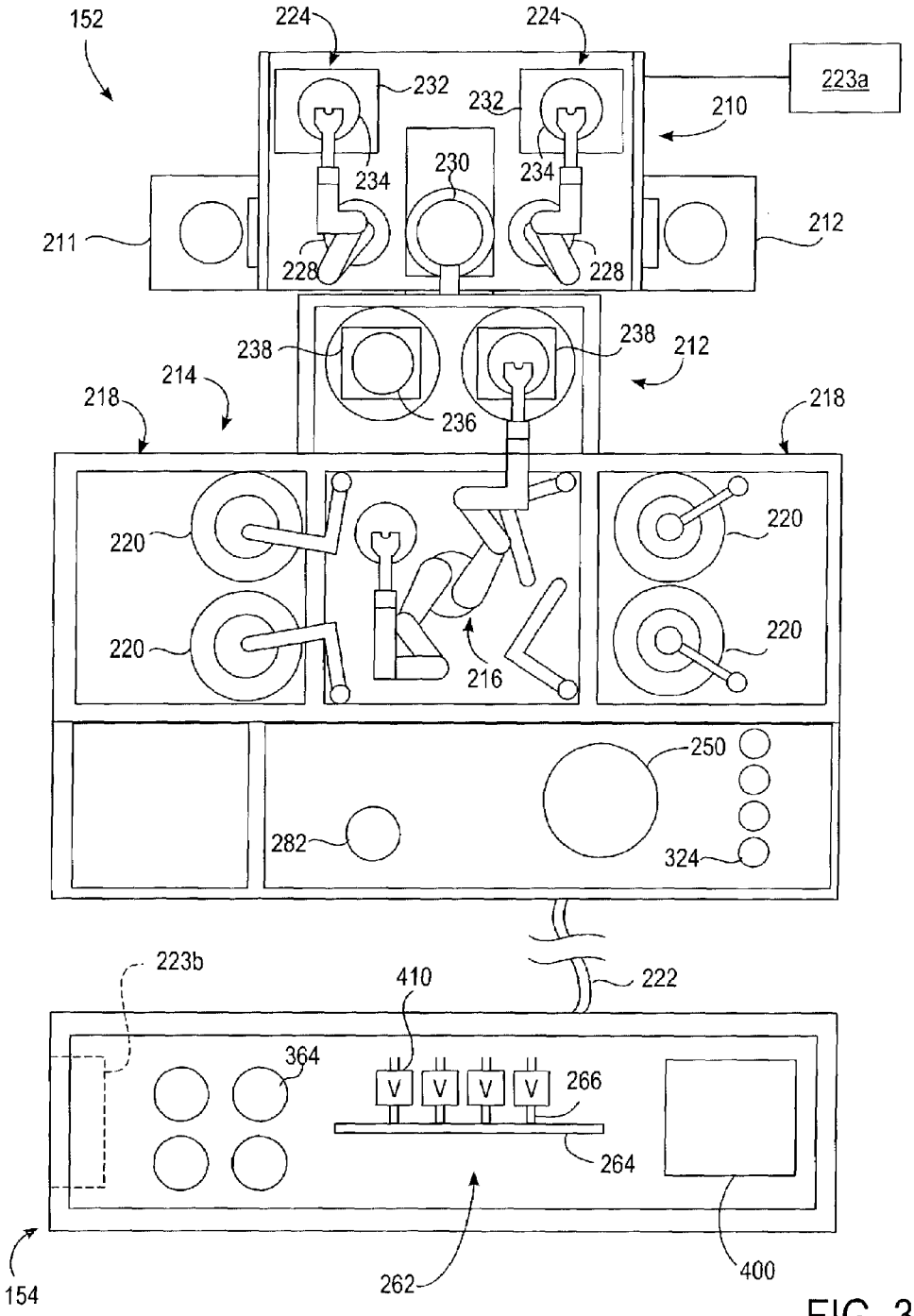
FIG. 3 is a mechanical schematic view of the electroplating system of FIG. 2.

FIG. 2 is a perspective view of an electrochemical deposition system 150 in accordance with one embodiment of the inventions. FIG. 3 is a mechanical schematic view of the electro-chemical deposition system of FIG. 2. Referring to both FIGS. 2 and 3, the electro-chemical deposition system 150 includes an electroplating tool platform 152 and a dosing system platform 154, which doses an electrochemical deposition solution for the electroplating tool platform 152. As explained in greater detail below, in one embodiment, the majority of the electrochemical deposition solution, which in this embodiment is an electrolyte, recirculates locally in the electroplating tool platform 152. A relatively small flow of electrolyte is diverted to the dosing system platform 154 to be analyzed and dosed as needed. In addition, dosing may be achieved in a pressurized flow line rather than in an unpressurized reservoir or holding tank. As a consequence of these and other features discussed below, the complexity of the overall system 150 can be substantially reduced and the reliability increased.

In the illustrated embodiment, the electroplating tool platform 152 generally comprises a loading station 210, a thermal anneal chamber 211, a spin-rinse-dry (SRD) station 212 and a mainframe 214. Preferably, the electroplating tool platform 152 is enclosed in a clean environment using panels such as plexiglass panels. The mainframe 214 generally comprises a mainframe transfer station 216 and a plurality of processing stations 218. Each processing station 218 includes one or more processing cells 220.

An architecture system and method in accordance with the present invention is applicable to a variety of electrochemical deposition systems and electrochemical deposition processes. Thus, the electrochemical deposition system may utilize a variety of different types of electro-chemical deposition cells. An example of a suitable fountain type electroplating cell is described in copending application Ser. No. 09/263,126, filed Mar. 5, 1999 and entitled "Apparatus for Electro-Chemical Deposition of Copper Metallization with the Capability of In-Situ Thermal Annealing" and assigned to the assignee of the present application. Similarly, the electrochemical deposition system may utilize a variety of different electrochemical deposition solutions including electrolytes.

The dosing system platform 154 receives a relatively small flow of electrolyte via flow lines 222 from the electroplating tool platform 152 to dose with the appropriate chemicals prior to returning the electrolyte to the electroplating tool platform 152. The dosing system platform 154 may be positioned adjacent the electroplating tool platform 152 or at a substantial distance from the electroplating tool platform 152 such as on another floor of the factory. The electroplating tool platform 152 also includes a control system 223*a*, typically comprising a programmable microprocessor. The control system 223*a* may control the dosing system platform 154 as well, either as a complete controller or in combination with another controller 223*b* disposed on the dosing system platform 154. The controller 223*b*, like the controller 223*a* typically comprises a programmable microprocessor.

The loading station 210 preferably includes one or more wafer cassette receiving areas 224, one or more loading station transfer robots 228 and at least one wafer orientor 230. The number and positions of the wafer cassette receiving areas, loading station transfer robots 228 and wafer orientors included in the loading station 210 can be configured according to the desired throughput of the system. As shown for one embodiment in FIGS. 2 and 3, the loading station 210 includes two wafer cassette receiving areas 224, two loading station transfer robots 228 and one wafer orientor 230. A wafer cassette 232 containing wafers 234 is loaded onto the wafer cassette receiving area 224 to introduce wafers 234 into the electroplating tool platform. The loading station transfer robot 228 transfers wafers 234 between the wafer cassette 232 and the wafer orientor 230. The loading station transfer robot 228 comprises a typical transfer robot commonly known in the art. The wafer orientor 230 positions each wafer 234 in a desired orientation to ensure that the wafer is properly processed. The loading station transfer robot 228 also transfers wafers 234 between the loading station 210 and the SRD (spin-rinse-dry) station 212 and between the loading station 210 and the thermal anneal chamber 211.

Figure 1:
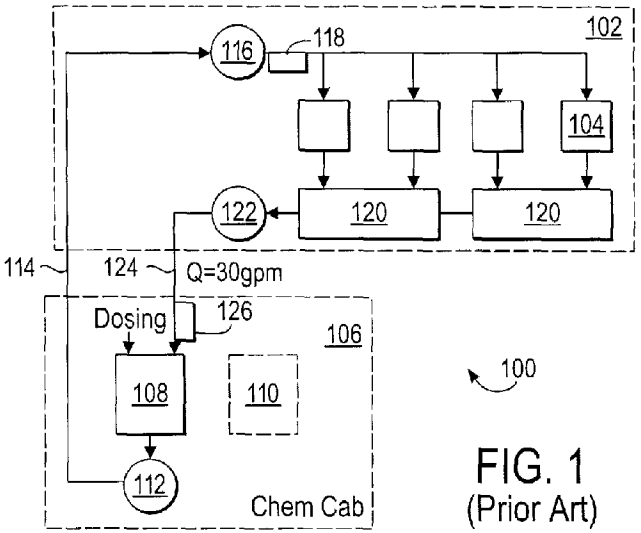
FIG. 1 (Prior Art)
FIG. 1 is a flow circuit schematic diagram of a prior art electrochemical plating system.
Figure 4:
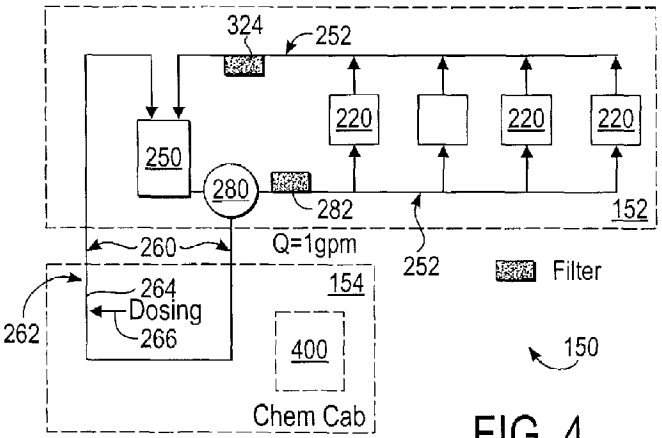
FIG. 4 is a fluid flow circuit schematic diagram of the electroplating system of FIGS. 2 and 3.

FIG. 4 shows a fluid flow circuit schematic diagram of the electro-chemical deposition system 150 of FIGS. 2 and 3. Referring to FIGS. 2–4, the electroplating tool platform 152 includes a main reservoir or holding tank 250 for the electrolyte. The main reservoir 250 is coupled by a first fluid recirculation circuit 252, which recirculates the electrolyte from the reservoir 250 to the electrolytic cells 220 and back to the main reservoir 250 of the electroplating tool platform 152. It should be appreciated that, in this embodiment, the electrolyte recirculates between the main reservoir and the processing cells 220 while remaining primarily in the electroplating tool platform 152. By recirculating locally in this reservoir-cell recirculation circuit 252, the complexity of the overall system can be substantially reduced.

To achieve this, it has been recognized by the present inventors that a relatively small flow of electrolyte may be diverted from the electroplating tool platform 152 and directed by a second fluid recirculation circuit 260 to the dosing system platform 154 to be dosed and returned to the reservoir 250 of the electroplating tool platform 152. In this manner, the electrolyte flowing through the processing cells 220 circulates primarily through the reservoir-cell recirculation circuit 252 of the electroplating tool platform 152. However, by diverting a relatively small flow through the reservoir-dosing system recirculation circuit 260 to the dosing system platform 154, the electrolyte flowing through the processing cells may be maintained at the desired chemical composition by the dosing system platform 154.

In another feature of the illustrated embodiments, the dosing system platform 154 has a dosing unit 262, which does not require any dosing reservoir on the dosing system platform 154 during normal dosing operations. Instead, as explained in greater detail below, the dosing unit 262 of the illustrated embodiment is primarily a pressurized flow line 264 having a plurality of inlets 266 for each fluid chemical to be added to the flow of electrolyte flowing through the flow line 264 of the dosing unit 262. As a consequence, the complexity of the system may be substantially reduced.

For example, the electrochemical deposition system 150 of the illustrated embodiment has only a single pump 280, which is disposed in the electroplating tool platform 152. Since the dosing system platform 154 does not utilize an unpressurized reservoir for dosing, a pump which would be used to pump electrolyte from such a dosing reservoir may be eliminated. It is believed that the single pump 280 disposed in the electroplating tool platform 152 is sufficient to recirculate the electrolyte through the primary recirculation circuit 252 of the electroplating tool platform 152 and to recirculate the lesser flow of electrolyte through the secondary recirculation circuit 260 coupling the dosing system platform 154 to the electroplating tool platform 152.

Because the flow of electrolyte flowing the reservoir-dosing system recirculation circuit 260 may be relatively small (such as 0.1–5 gallons per minute (0.38–18.9 liters), for example), the supply and return lines of the recirculation circuit 260 may be made relatively small (such as a ¾ inch (19 mm) inner diameter, for example). By comparison, the supply and return lines of the primary recirculation circuit 252 may be on the order of 1½ inch (38 mm) inner diameter or larger, to provide an electrolyte flow of 30 gallons (113.5 liters) per minute, for example, depending upon the size and number of processing cells in the tool platform 152.

For example, the average flow cross-sectional area of the primary recirculation circuit 252 may be 100–300% larger than that of the reservoir-dosing system recirculation circuit 260, to provide an average flow rate in the primary recirculation circuit 252 that is 600–3000% larger than that of the reservoir-dosing system recirculation circuit 260. The relative sizes of the recirculation circuits will of course depend upon the particular application. However, reducing the size of the supply and return lines of the recirculation circuit 260 is particularly convenient should the dosing system platform 154 be located a large distance (such as 20 feet (6 meters) for example) or even on a different floor from the electroplating tool platform 152.

For example, the dosing system platform 154 may be separated from the electroplating tool platform by 1–50 meters (3.3–164 feet) or more. Notwithstanding a large separation between the dosing system platform 154 and the electroplating tool platform 152, it is believed that an additional boost pump such as the pump 116 of the prior art system, for pumping the electrolyte from a chemical cabinet may be eliminated in many applications of an electroplating system in accordance with the present invention. However, in some applications, particularly those having a very large separation between the two platforms, a booster pump may be appropriate.

Still further, by eliminating a dosing reservoir from the dosing platform, the need for complex controls to balance the electrolyte level of such a dosing reservoir with the electrolyte level of a reservoir in the tool platform can be reduced or eliminated. Instead, if desired, the electro-chemical deposition system 150 may utilize a single reservoir 250 during plating operations such that the volume of the system may be readily fixed at a particular level. As a consequence, the controls may be substantially simplified.

In addition, the reservoir-cell recirculation circuit 252 has a filter or set of filters 282 and 324 disposed in the electroplating tool platform 152. It is believed that these filters are sufficient to filter the electrolyte such another set of filters disposed in the dosing system platform 154 to filter the electrolyte flowing through the secondary recirculation circuit 260 may be avoided if desired.

Figure 5A:
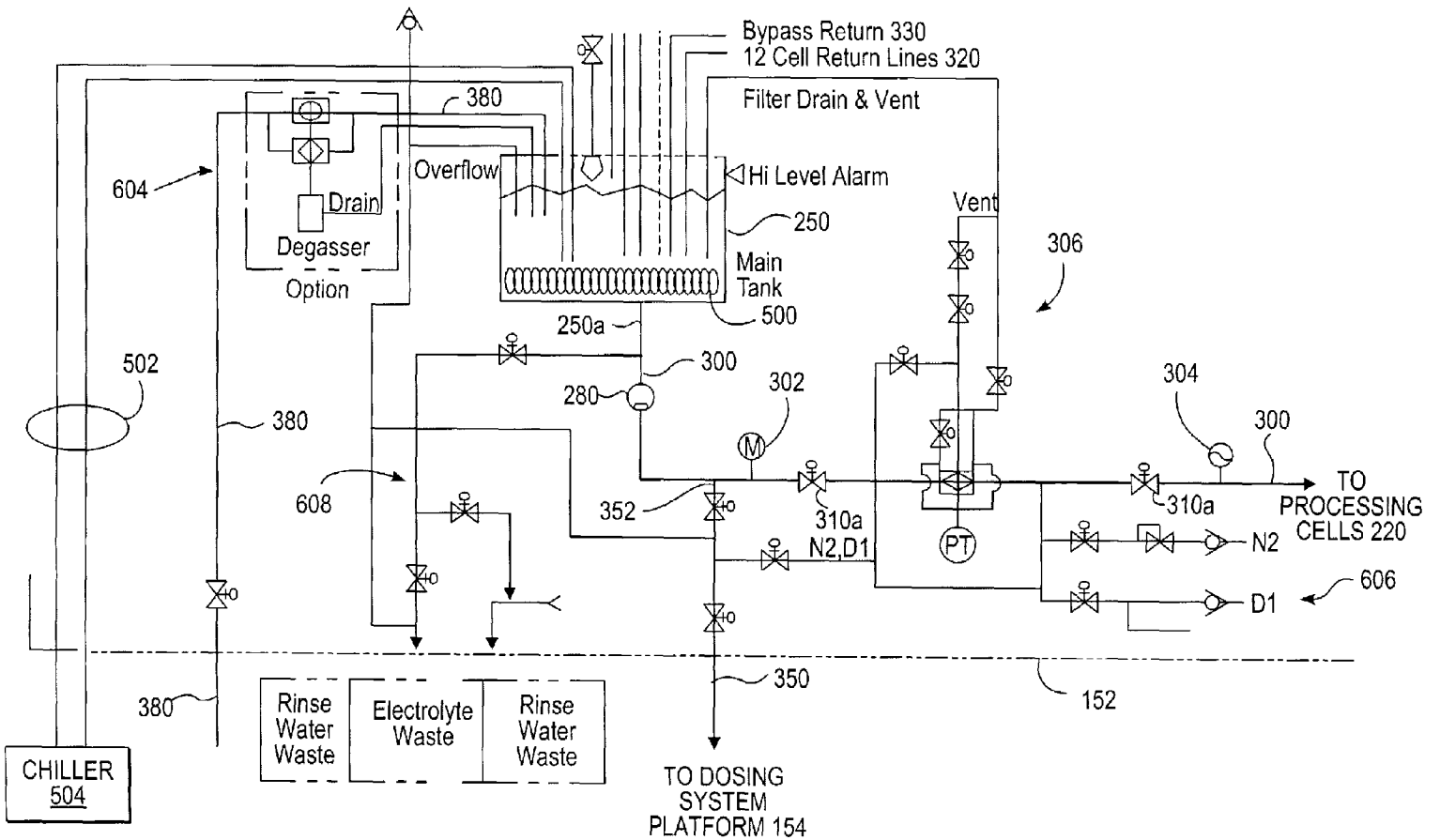
FIGS. 5A and 5B are fluid flow schematic diagrams showing the reservoir-cell recirculation circuit of the electroplating tool platform of FIG. 4 in greater detail.
Figure 5B:
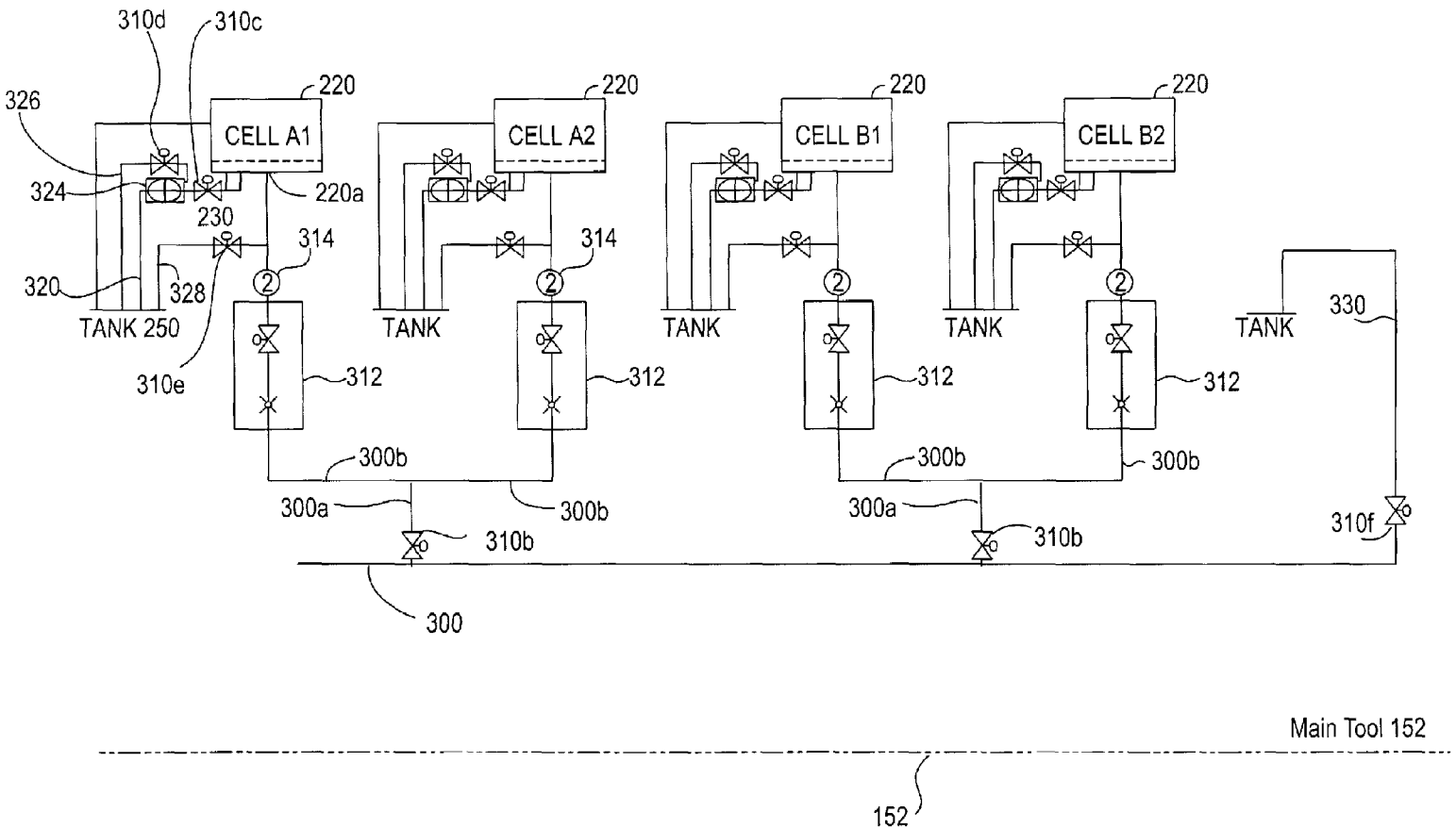

FIGS. 5A and 5B are schematic diagrams showing the reservoir-cell recirculation circuit 252 of the electroplating tool platform 152 in greater detail. As depicted therein, the reservoir-cell recirculation circuit 252 includes a main supply line 300 (FIG. 5A), which couples a drain outlet 250*a* of the main reservoir 250 to the inlet of the pump 280 which pumps a flow of electrolyte from the main reservoir 250 to the array of processing cells 220 (FIG. 5B) via the supply line 300. The pump speed and activation time is controlled by the controller 223*a* (FIGS. 2 and 3), which monitors the flow through the supply line 300. A pressure sensor 302 and a flow meter 304 coupled to the supply line 300 provide output signals to the controller 223*a*, which are indicative of the pressure and flow rate, respectively, of electrolyte through the supply line 300. The main filter 282 is also disposed in the main supply line to filter the electrolyte being pumped to the array of processing cells 220 (FIG. 5B). A bleed indicated generally at 306 bleeds bubbles from the filter 282 and vents into the main reservoir 250. The main supply line 300 also includes suitable shut-off and control valves 310*a*, which may be controlled manually or by the controller 223*a*.

Referring now to FIG. 5B, in the illustrated embodiment, the main supply line 300 of the reservoir-cell recirculation circuit 252 of the electroplating tool platform 152 includes two branched supply lines 300*a*, each of which includes two branched supply lines 300*b*. Each supply line 300*a* has a control and/or shut off valve 310*b*. Each supply line 300*b* supplies a flow of electrolyte to the inlet of one of the processing cells 220 of the array. To control the electrolyte flow rate into the inlet 220*a* of each processing cell, each processing cell supply line 300*b* includes a control loop comprising a control valve 312 and a flow meter 314. The flow rate control loop for each processing cell 220 may be controlled by the controller 223*a* or manually, if desired.

The reservoir-cell recirculation circuit 252 further includes a plurality of return lines 320, each of which is coupled to an electrolyte discharge outlet 220*b* of an associated processing cell 220. Each return line 320 may have a shutoff and/or control valve 310*c* and a filter 324 to filter the electrolyte being discharged from the associated processing cell 220. The outlet of each filter 324 is coupled to the main reservoir 250. In this manner, the recirculation circuit 252 provides a complete circuit for recirculating the electrolyte from the main reservoir 250 to the array of processing cells and back to the main reservoir. In the illustrated embodiment, the electrolyte flow remains substantially local within the electroplating tool platform 152 while flowing in the reservoir-cell recirculation circuit 252.

In addition to the return lines 320, other return lines feed into the main reservoir 250. More specifically, each filter 324 of the array of processing cells 220 has a bypass line 326 with an associated shut-off control valve 310*d* which permits the flow of electrolyte to bypass the filter 324 and return to the main reservoir 250 should it be desired. An anode bypass line 220*b* exchanges fresh electrolyte across the anode surface of the cell. The supply line 300*b* for each processing cell 220 is coupled to a bypass line 328 with an associated shut-off control valve 310*e*, which permits the flow of electrolyte to bypass the associated processing cell and return to the main reservoir 250. Also, the main supply line 300 is coupled to a bypass line 330 with an associated pressure drop valve 310*f*, which permits the flow of electrolyte to bypass the processing cells and return to the main reservoir 250.

Figure 5C:
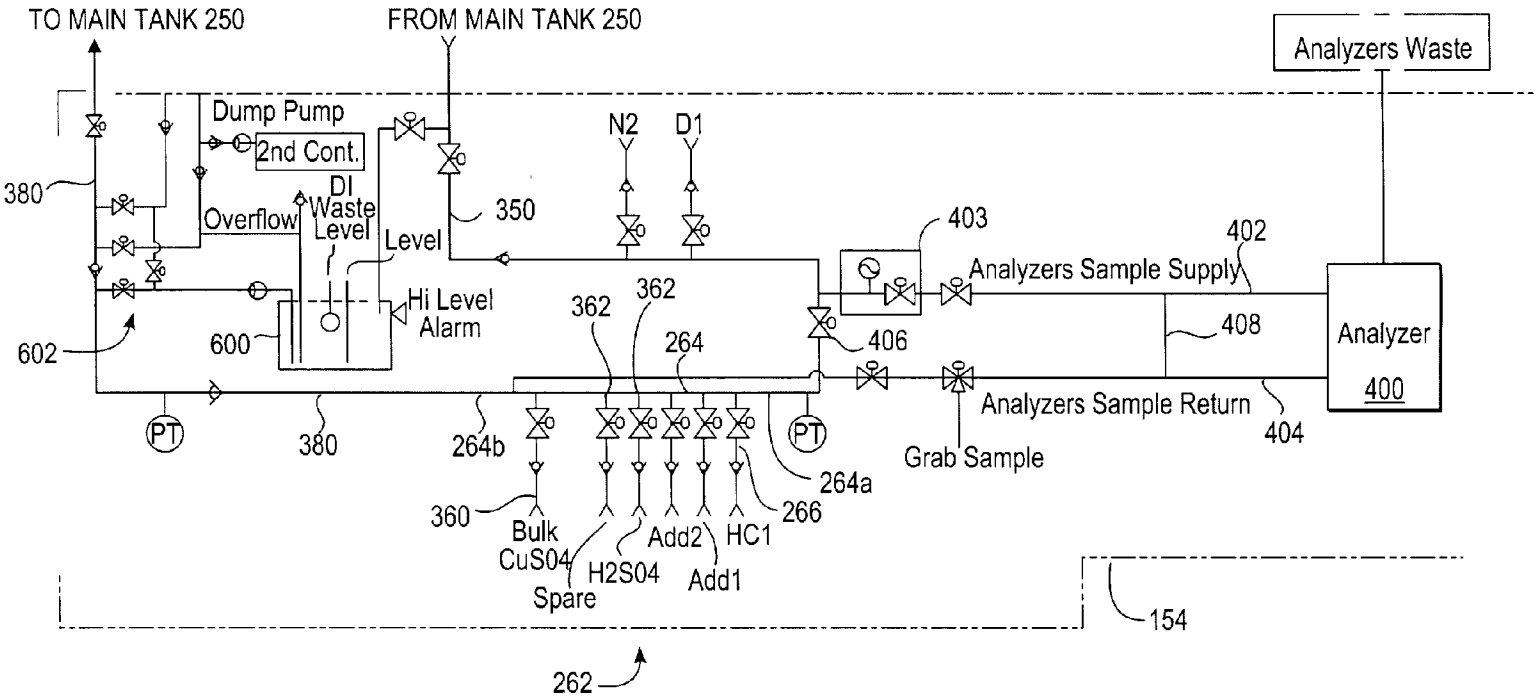
FIG. 5C is a fluid flow schematic diagram showing the reservoir-dosing system recirculation circuit of FIG. 4 in greater detail.

The reservoir-dosing system recirculation circuit 260 includes a dosing system supply line 350 (FIG. 5A) having an inlet coupled to an outlet 352 of the main supply line 300 of the reservoir-cell recirculation circuit 252. As shown in FIG. 5C, the dosing system supply line 350 diverts a small flow of electrolyte from the main supply line 300 to an inlet 264*a* of the dosing system flow line 264 of the dosing unit 262, and thus provides a pressurized flow of electrolyte through the dosing system flow line 264. The dosing unit 262 includes a plurality of additive supply lines 360, each of which is coupled to one of a plurality of inlets 266 of the dosing system flow line 264. Each additive supply line 360 is coupled to one of a plurality of source tanks 364 (FIG. 3) to provide the various constituent chemicals of the desired electrolyte to the dosing system flow line 264. In the illustrated embodiment, an additive supply line 360 is provided for each of the constituents, copper sulfate $CuSO_4$, sulfuric acid $H_2SO_4$, and hydrochloric acid HCl. The particular additives may vary, depending upon the desired electrochemical solution and the desired electrochemical deposition process.

The reservoir-dosing system recirculation circuit 260 further includes a dosing system return line 380 having an inlet coupled to an outlet 264*b* of the dosing system flow line 265. As shown in FIG. 5A, the dosing system return line 380 is coupled to the main reservoir 250 of the electroplating tool platform 102. In this manner, the recirculation circuit 260 provides a complete circuit for recirculating the electrolyte from the main reservoir 250 to the dosing unit 262 of the dosing system platform 154 and back to the main reservoir. In the illustrated embodiment, the electrolyte remains pressurized within the dosing system platform 154 while flowing in the dosing unit 262. The electrolyte does not become unpressurized until it flows back into the unpressurized reservoir 250 of the tool platform 102. The electrolyte in the reservoir-dosing recirculation unit circuit 260 is pressurized by the pump 280 which is shared with the reservoir-cell recirculation circuit 252.

As shown in FIG. 5C, the chemical composition of the electrolyte flowing through the reservoir-dosing system recirculation circuit 260 is analyzed by an analyzer 400 disposed in the dosing system platform 154. The reservoir-dosing system recirculation circuit 260 includes an analyzer sample supply line 402 coupled to the supply line 350 through a controller 403, which diverts a small sample flow of electrolyte from the supply line 350 to the analyzer 400 for chemical analysis. An analyzer sample return line 404 returns the sample flow of electrolyte to the return line 380 at a point downstream of the dosing unit 262. In the illustrated embodiment, the sample flow of electrolyte through the sample supply line 402, the analyzer 400 and the sample return line 404 remains pressurized.

The supply line 300 has a pressure drop 406 which may be set at a particular value (such as 1 gallon (3.8 liters) per minute, for example) to provide the desired flow into the sample supply line 402. A bypass line 408 continues the flow of pressurized electrolyte to the sample return line 404.

The analyzer 400 of the illustrated embodiment is a titration and CBS type analyzer ("Bantam" model) and is manufactured by Parker Technology. Other commercially available analyzers may be used as well. The analyzer 400 has a syringe to withdraw a sample from the sample flow for analysis. The analyzer 400 is electrically coupled to one or more of the controllers 223*a* and 223*b* and provides electrical signals to the appropriate controller, which are representative of the chemical analysis of the sample drawn from the electrolyte flowing through the analyzer. In response the controller, as needed, opens the appropriate control valves 410 (FIG. 3) coupled to the additive inlets 266 to admit the appropriate quantities of additives to mix with the flow of electrolyte flowing through the dosing flow line 264 of the dosing unit 262 to achieve the desired chemical composition of the electrolyte in the system 150. The control valves 410 may include appropriate flow meters to measure the flow of additive in the associated additive inlet to provide a suitable flow control loop for each additive inlet 266.

Figure 6:
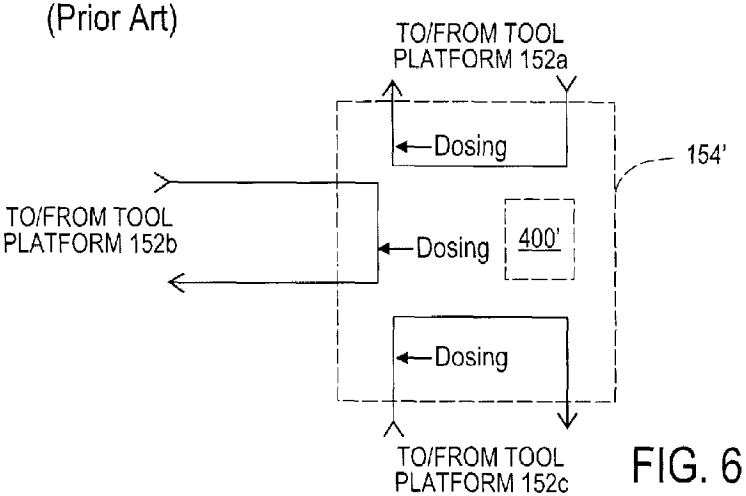
FIG. 6 is a fluid flow schematic diagram of a dosing system platform in accordance with an alternative embodiment.

Because a pressurized flow line is used to perform dosing rather than a large reservoir, the size or footprint of the dosing system platform 154 may be substantially reduced as compared to many prior chemical cabinets. Furthermore, a single dosing system platform 154' may be used to dose and/or analyze the electrolyte from a plurality of electroplating tool platforms 152*a*–152*c* as shown in FIG. 6 while maintain a relatively small footprint. The dosing system platform 154' may use one set of additive sources 364 (FIG. 3) to supply the additives for each of the dosing units of the platform 154'. A single analyzer 400 may be used to analyze the electrolyte from each of the tool platforms or alternatively, separate analyzers may be disposed on the platform 154' for use with the electrolyte from each tool if more complete separation of the flow lines is desired.

The reservoir 250 of the tool platform 152 further has a heat exchanger 500 which is coupled by supply and return lines 502 to a chiller unit 504. It is believed that the primary source of undesirable heating of the electrolyte is the pump or pumps of the system. In a system in accordance with the present invention, the size and number of pumps may be reduced because most of the electrolyte circulates locally on the electroplating tool platform 152. The need to overcome a large head loss resulting from shuttling most or all of the system electrolyte to and from a remote chemical cabinet can be reduced or eliminated. As a consequence, the drop in pump horsepower which the system may require can reduce the system cooling requirements at the same time. Moreover, it is believed that the electrolyte temperature may be more effectively controlled in many applications because the heat exchanger is located close to the point of delivery to the processing cells. In one embodiment, the reservoir 250 (and associated heat exchanger 500) may be located immediately adjacent to the processing cells 220. Alternatively, the reservoir 250 may be spaced less than 1 or 2 meters (3.3 or 6.6 feet) from the processing cells but is preferably spaced less than 5 meters (16.4 feet) from the processing cells to reduce pumping needs and increase temperature control accuracy. Of course, the actual distance may vary depending upon the particular application.

The dosing system platform 154 has a maintenance reservoir 600 (FIG. 5*c*) and associated maintenance plumbing indicated generally at 602. The reservoir 600 is not intended to be used during dosing but to provide a drain receptacle to permit the dosing system to be repaired or otherwise serviced when not in operation. Similarly, the plating tool platform 152 has maintenance plumbing indicated generally at 604, 606 and 608 which is generally not used during plating but provide a drain system for servicing the plating platform when not in operation.

Although various embodiments which incorporate the teachings of the present invention have been shown and described in detail herein, those skilled in the art can readily devise many other varied embodiments that still incorporate these teachings.

What is claimed is:

1. A system for electroplating semiconductor substrates, comprising:

a mainframe comprising:

two or more electrolytic plating cells;

an electrolyte reservoir;

a supply line that is in fluid communication with at least one of the two or more electrolytic plating cells and a bypass line that is in fluid communication with the electrolyte reservoir; and a pump that is in fluid communication with the supply line and the electrolyte reservoir, wherein the pump is adapted to deliver a fluid from the electrolyte reservoir to the supply line; and a dosing system platform positioned a distance from the mainframe, wherein the dosing system platform comprises:

an electrolyte fluid line having an inlet that is in fluid communication with the supply line and an outlet that is in fluid communication with the electrolyte reservoir; and two or more additive sources connected to the electrolyte fluid line that are adapted to dose two or more additives into a fluid flowing through the electrolyte fluid line.

2. The system of claim 1, wherein the dosing system platform further comprises an analyzer assembly that comprises:

a sample supply line having a supply line inlet and a supply line outlet that are in fluid communication with the electrolyte fluid line; and an electrolyte analyzer in fluid communication with the supply line inlet and the supply line outlet, wherein the analyzer is adapted to analyze the concentration of at least one component of a fluid flowing through the electrolyte fluid line.

3. The system of claim 2, wherein the dosing system platform further comprises:

a controller that is adapted to receive a signal from the electrolyte analyzer and then control the amount of at least one additive delivered to the fluid flowing in the electrolyte fluid line.

4. The system of claim 2, wherein the inlet line of the sample supply line assembly is connected to the electrolyte fluid line upstream of the one or more additive sources.

5. The system of claim 1, wherein the mainframe further comprises a heat exchanger that is thermally coupled to a fluid positioned inside the electrolyte reservoir and is adapted to control the temperature of the fluid positioned inside the electrolyte reservoir.

6. The system of claim 1, wherein the distance from the mainframe to the dosing system is greater than about 1 meter.

7. The system of claim 1, wherein the flow cross-sectional area of the supply line is larger than the flow cross-sectional area of the electrolyte fluid line.

8. The system of claim 7, wherein the supply line average flow cross-sectional area is 100–300% larger than the electrolyte fluid line average flow cross-sectional area.

9. The system of claim 1, further comprising a pressure sensor in connected to the supply line; and a controller that is in communication with the pump and the pressure sensor and is adapted to control the pressure in the supply line by controlling the pump speed.

10. A system for electroplating semiconductor substrates in a clean room environment, comprising:

a mainframe comprising:

two or more electrolytic plating cells;

an electrolyte reservoir;

a supply line that is in fluid communication with the two or more electrolytic plating cells and a bypass line that is in fluid communication with the electrolyte reservoir;

a filter in fluid communication with the supply line, wherein the filter is positioned in the supply line upstream of the two or more electrolytic plating cells; and a pump that is in fluid communication with the supply line and the electrolyte reservoir, wherein the pump is adapted to deliver a fluid from the electrolyte reservoir to the supply line; and a dosing system platform positioned a distance from the mainframe, wherein the dosing system platform comprises:

an electrolyte fluid line having an inlet that is in fluid communication with the supply line and an outlet that is in fluid communication with the electrolyte reservoir; and two or more additive sources connected to the electrolyte fluid line that are adapted to dose two or more additives into a fluid flowing through the electrolyte fluid line.

11. A system for electroplating semiconductor substrates, comprising:

a first mainframe comprising:

two or more electrolytic plating cells;

a first electrolyte reservoir;

a first pump that is in fluid communication with the two or more electrolytic plating cells and is adapted to deliver a fluid from the first electrolyte reservoir to the two or more electrolytic plating cells; and a bypass line that is in fluid communication with the first electrolyte reservoir;

a second mainframe comprising:

two or more electrolytic plating cells;

a second electrolyte reservoir;

a second pump that is in fluid communication with the two or more electrolytic plating cells and is adapted to deliver a fluid from the second electrolyte reservoir to the two or more electrolytic plating cells;

a bypass line that is in fluid communication with the second electrolyte reservoir;

a dosing system platform positioned a distance from the first and second mainframe, wherein the dosing system platform comprises:

a first electrolyte fluid line having an inlet that is in fluid communication with the first pump and an outlet that is in fluid communication with the first electrolyte reservoir;

a second electrolyte fluid line having an inlet that is in fluid communication with the second pump and an outlet that is in fluid communication with the second electrolyte reservoir; and one or more additive sources connected to the first and second electrolyte fluid lines, wherein the one or more additive sources are adapted to dose one or more additives into a fluid flowing through the first electrolyte fluid line or a fluid flowing through the second electrolyte fluid line.

12. The system of claim 11, further comprising:

a first sample supply line having a first fluid inlet and a first fluid outlet, wherein the first fluid inlet and the first fluid outlet are in fluid communication with the first electrolyte fluid line;

a second sample supply line having a second fluid inlet and a second fluid outlet, wherein the second fluid inlet and the second fluid outlet are in fluid communication with the second electrolyte fluid line; and an electrolyte analyzer in fluid communication with the first sample supply line and the second sample supply line, wherein the analyzer is adapted to analyze the concentration of at least one component in the fluid flowing through the first or second electrolyte sample supply lines.

* * * * *